US008279079B2

(12) United States Patent
Bergman et al.

(10) Patent No.: US 8,279,079 B2
(45) Date of Patent: Oct. 2, 2012

(54) CONTROL DEVICE FOR CONTROLLING THE HUE OF LIGHT EMITTED FROM A LIGHT SOURCE

(75) Inventors: Anthonie H. Bergman, Nuenen (NL); Lucius T. Vinkenvleugel, Veldhoven (NL); Bram F. Joosen, Hellerup (DK); Hebertus M. R. Cortenraad, Saint Egreve (FR)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 13/110,030

(22) Filed: May 18, 2011

(65) Prior Publication Data

US 2011/0216085 A1 Sep. 8, 2011

Related U.S. Application Data

(63) Continuation of application No. 12/282,836, filed on Sep. 12, 2008, now Pat. No. 7,948,394.

(30) Foreign Application Priority Data

Mar. 13, 2006 (EP) ..... 06111041

(51) Int. Cl.
*G08B 5/00* (2006.01)
*G09G 5/02* (2006.01)

(52) U.S. Cl. ..... 340/815.65; 340/815.43; 345/593

(58) Field of Classification Search ..... 340/815.43, 340/815.45, 815.6, 815.62, 815.63, 815.65; 345/1, 3, 518, 589, 593, 594; 362/85, 231, 362/233, 234; 358/1.16, 2.1; 382/162, 167
See application file for complete search history.

(56) References Cited

U.S. PATENT DOCUMENTS

| | | | | |
|---|---|---|---|---|
| 5,249,263 | A * | 9/1993 | Yanker | 345/594 |
| 5,307,334 | A | 4/1994 | Sato | |
| 5,778,885 | A | 7/1998 | Doyama et al. | |
| 5,909,220 | A * | 6/1999 | Sandow | 345/589 |
| 6,058,207 | A * | 5/2000 | Tuijn et al. | 382/162 |
| 6,552,495 | B1 | 4/2003 | Chang | |
| 6,577,080 | B2 | 6/2003 | Lys et al. | |
| 7,014,336 | B1 | 3/2006 | Ducharme et al. | |
| 7,358,929 | B2 | 4/2008 | Mueller et al. | |
| 7,394,561 | B2 * | 7/2008 | Moro | 358/1.16 |
| 8,077,340 | B2 * | 12/2011 | Moro | 358/1.16 |
| 2003/0156752 | A1 | 8/2003 | Turpin et al. | |
| 2005/0128743 | A1 | 6/2005 | Chuey et al. | |
| 2005/0174473 | A1 | 8/2005 | Morgan et al. | |
| 2007/0230159 | A1 | 10/2007 | Cortenraad et al. | |

FOREIGN PATENT DOCUMENTS

| | | |
|---|---|---|
| DE | 19942177 A1 | 3/2001 |
| DE | 10239449 | 8/2003 |
| EP | 1528785 A1 | 5/2005 |

(Continued)

*Primary Examiner* — Van T. Trieu
(74) *Attorney, Agent, or Firm* — Mark L. Beloborodov

(57) ABSTRACT

The invention relates to a control device for controlling the hue of light emitted by a light source. The control device comprises a hue selection surface capable of displaying one or more hues available for said light of said light source and interaction detection means for detecting interaction between said hue selection surface and a user of said control device in selecting said hue for said light of said light source. The control device allows the user to select the desired hue for the light source simply by interacting with the hue selection surface that displays the available hues. Consequently, the control device can be operated easily and intuitively.

18 Claims, 5 Drawing Sheets

FOREIGN PATENT DOCUMENTS

| | | | |
|---|---|---|---|
| EP | 1542437 | | 6/2005 |
| JP | 04048585 | A | 2/1992 |
| JP | 05040569 | A | 2/1993 |
| WO | 99/66257 | | 12/1999 |
| WO | 03015067 | A1 | 2/2003 |
| WO | 2004072840 | A1 | 8/2004 |
| WO | 2005057328 | | 6/2005 |
| WO | 2005107338 | A2 | 11/2005 |
| WO | 2006048916 | A2 | 5/2006 |
| WO | 2006134529 | A2 | 12/2006 |

* cited by examiner

CONTROL DEVICE FOR CONTROLLING THE HUE OF LIGHT EMITTED FROM A LIGHT SOURCE

CROSS REFERENCE TO RELATED APPLICATIONS

This application is a continuation application filed under 35 USC §120 of application Ser. No. 12/282,836, with a filing date of Sep. 12, 2008 now U.S. Pat. No. 7,948,394.

FIELD OF THE INVENTION

Generally, the invention relates to light sources. More specifically, the invention relates to a control device for controlling the color of light emitted by a light source, in particular the hue of the light emitted by said light source.

BACKGROUND OF THE INVENTION

Light sources are widely used in several types of ambience lighting applications for creating a certain atmosphere, for example in a living room. More and more, these light sources comprise a plurality of light-emitting diodes (LEDs) capable of emitting different colors. Amongst other types of light sources, light sources that use LEDs render it possible to control the color of the light emitted by such light sources.

Buttons to switch light sources on and off and dimming control means are familiar to most users of light sources. However, as the possibility of varying the color of the light emitted by a light source is new to many people, there is a need for an easy-to-use and intuitive control device for these light sources.

SUMMARY OF THE INVENTION

It is an object of the invention to provide a control device for controlling the color of light emitted from a light source that is easy and intuitive to operate.

The invention provides a control device for controlling the hue of light emitted by a light source. The control device comprises a hue selection surface capable of displaying one or more hues available for said light of said light source and interaction detection means for detecting an interaction between said hue selection surface and a user of said control device in selecting said hue for said light of said light source.

The control device presents the user with a simple selection of the desired hue for the light source by interacting with the hue selection surface that displays the available hues. Consequently, the control device can be operated easily and intuitively.

It should be noted that the interaction detection means may involve mechanical detection means (e.g. a pressure sensor), electrical detection means (e.g. a capacitive sensor), optical detection means (e.g. visual sensing) or a combination of these.

The embodiment of the invention as defined in claim 2 provides the advantage that the available hues for the light can be easily indicated through printing of (substantially) corresponding hues on the hue selection surface.

Since the light sources are capable of emitting light of a plurality of hues, the hue selection surface should preferably allow the selection of a corresponding plurality of hues. As a result of the limited dimensions of the hue selection surface, the display of a large amount of hues may cause difficulties for the user in selecting the precise desired hue. The embodiments of the invention as defined in claims 3 to 5 enable the user to zoom in on the hue selection surface in order to decrease the sensitivity in selecting a particular hue through interaction between the user and the hue selection surface.

In particular, the embodiment of the invention as defined in claim 3 renders such a zooming action possible by assigning a subset of the available printed hues to the hue selection surface. Since the hue selection surface comprises the complete range of available hues, the user can look at the light source itself after the subset of available hues has been assigned in order to select the desired hue of this subset.

The assignment of the subset of available hues to the hue selection surface may be achieved by means of a dedicated zoom switch. However, as defined in claims 4 and 5, the assignment of the subset to the hue selection surface may also be triggered by the interaction of the user with the hue selection surface (e.g. duration of the interaction or velocity of the user's finger over the hue selection surface), which obviates the need for a dedicated zoom switch.

The embodiment of the invention as defined in claim 6 provides the advantage that an excellent match is obtained between the color of the light emitted by the light source and the color of the light emitted by the light-emitting elements. Moreover, the light-emitting elements of the control device can be made visible during operation of the control device in the dark. Also, in contrast to a preprinted range of available hues, the colors of the light-emitting elements are not corrupted by ambient light conditions.

It should be appreciated that the light-emitting elements may be an integral part of the hue selection surface or may be arranged near a selection surface where the actual selection of the hue is made, i.e. the hue selection surface comprises this selection surface for selecting the hue and the area that accommodates the light-emitting elements. The same holds, of course, for the printed hue selection surface as described above.

Similar to the hue selection surface with a printed range of available hues for the light of the light source, the embodiment with light-emitting elements that display the available hue may comprise a large amount of available hues such that it is difficult for the user to precisely select the desired hue. Therefore, the embodiments of the invention as defined in claims 7 to 10 provide a zoom function for the control device.

The embodiment of the invention as defined in claim 11 provides the advantage that the single hue selection surface is capable of displaying multiple spectra instead of merely a fully saturated full-spectrum hue selection surface. In an advantageous embodiment defined in claim 12, a different spectrum can be selected on the hue selection surface by a trigger dependent on the interaction between the user and the hue selection surface (e.g. by detecting the velocity of a user's finger moving over the hue selection surface). Of course, as defined in claims 16 and 17, the hue selection surface may also display (printed) or being capable of displaying (light-emitting elements) only a single hue in various degrees of saturation, or the black body line.

The embodiment of the invention as defined in claim 13 provides a display of the range of available hues for the light of the light source in portions. This embodiment, therefore, provides a further solution for how to select a desired hue from a plurality of available hues on a hue selection surface of limited dimensions.

The embodiment of the invention as defined in claim 14 allows the selected hue to be displayed always on the same part of the hue selection surface. The movement of a user's finger over the hue selection surface suggests that the user is handling a mechanical knob, with which the user may be more familiar.

The embodiment of the invention as defined in claim 15 provides the advantage that the number of light-emitting elements can be limited while the available range of hues is displayed as a continuous range.

The embodiment of the invention as defined in claim 18 provides the advantage that a continuous surface is obtained on which the available hues for the light source can be displayed and with which the user can interact in a natural, continuous manner.

The embodiments of the invention as defined in claims 19 to 21 provide the advantage of a saturation selection control.

It should be appreciated that the subject matter of several of the claims, or aspects thereof, may be combined.

The invention will be further illustrated with reference to the attached drawings, which schematically show preferred embodiments of the invention. It will be understood that the invention is not in any way restricted to these specific and preferred embodiments.

DETAILED DESCRIPTION OF THE DRAWINGS

Figure 1:
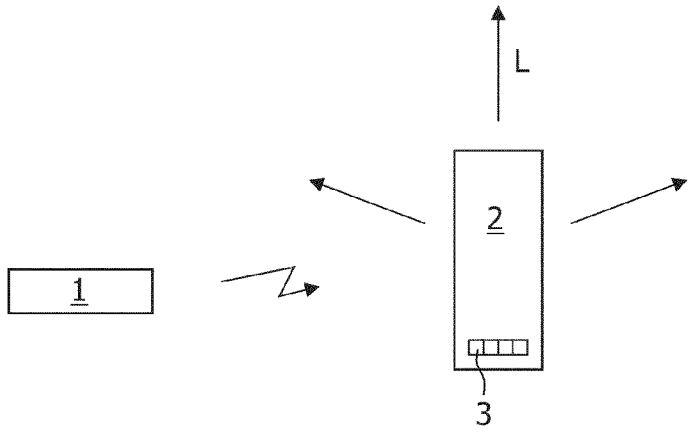
FIG. 1 schematically displays a light source controllable by a control device.

FIG. 1 is a schematic illustration wherein a control device 1 is used to control a light source 2 comprising a plurality of light-emitting diodes (LEDs) 3 of different colors that allow the light source 2 to emit light L of different colors. Control of the light source 2 by the control device 1 may be performed either in a wireless or in a wired (not shown) manner.

In particular, the control device 1 according to an embodiment of the invention is arranged to control the hue H of the light L of the light source 2. The color of the light L can be defined as the combination of the hue H and saturation S of the light L, as is well known in the art. The hue H of the light L represents the dominant wavelength, while the saturation S of the light L represents the dominance of the hue in the emitted light L; the saturation S is the ratio of the dominant wavelength to all wavelengths within the color of the emitted light. A saturation S of 100% for a particular hue H may represent a 'pure' hue H.

Figure 2A:
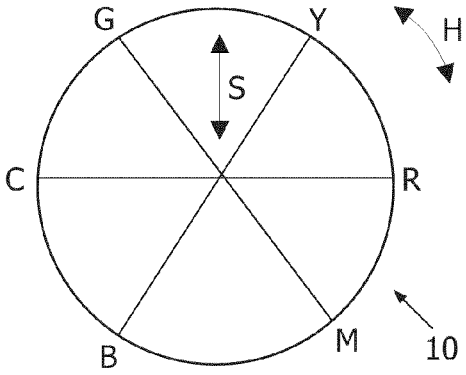
FIGS. 2A and 2B represent a color space.

FIG. 2A shows a color wheel 10 with the saturated colors green (G), yellow (Y), red (R), magenta (M), blue (B) and cyan (C) around the outer perimeter of the wheel 10. It should be appreciated that further (tertiary) saturated colors may be added to provide a full color wheel 10. The hue dimension is defined by the perimeter of the color wheel 10 representing the available hues H. On the other hand, the saturation dimension of the color wheel 10 is defined by the radial direction representing saturations S between 100% (perimeter) and 0% (center of color wheel 10). Clearly, the color wheel 10 provides a plurality of hue/saturation combinations.

Figure 2B:
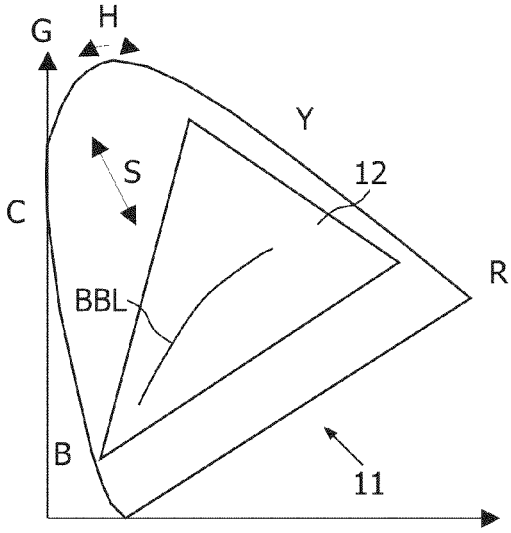

FIG. 2B is a well known representation 11 of the color space, commonly referred to as the CIE representation. The perimeter again represents the hues H, while the inbound direction defines the saturation S. Again, it will be clear that the CIE representation 11 defines a plurality of hue/saturation combinations. Since artificial light from a light source 2 is not capable of covering the entire range of hues H and saturations S, in practice a limited area 12, often referred to as gamut, is drawn to define the practically available hue/saturation combinations. The shape and size of the gamut 12 is determined by the locations of the LEDS 3 in the CIE representation 11.

It should be appreciated that a third characteristic of light L, viz. the brightness, is not represented in either the color wheel 10 or the CIE representation 11. The brightness or quantitative value of light L describes the overall intensity or strength of the light. The control device 1 may be capable of selecting a desired brightness as well.

Figure 3C:
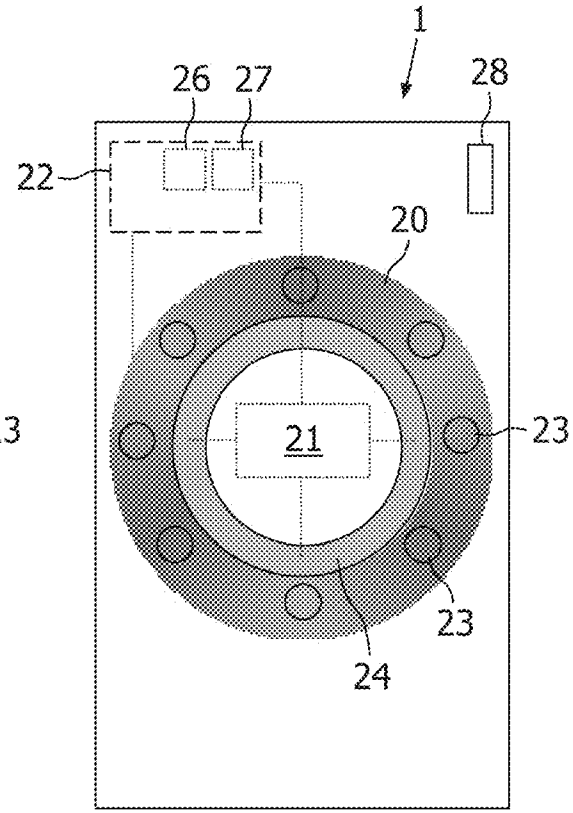
FIGS. 3A-3C are schematic illustrations of control devices according to embodiments of the invention.
Figure 3B:
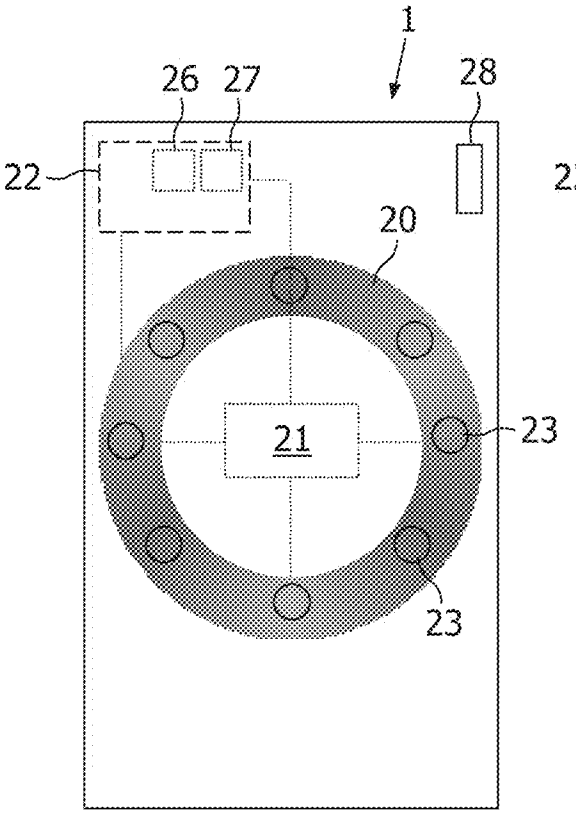
Figure 3A:
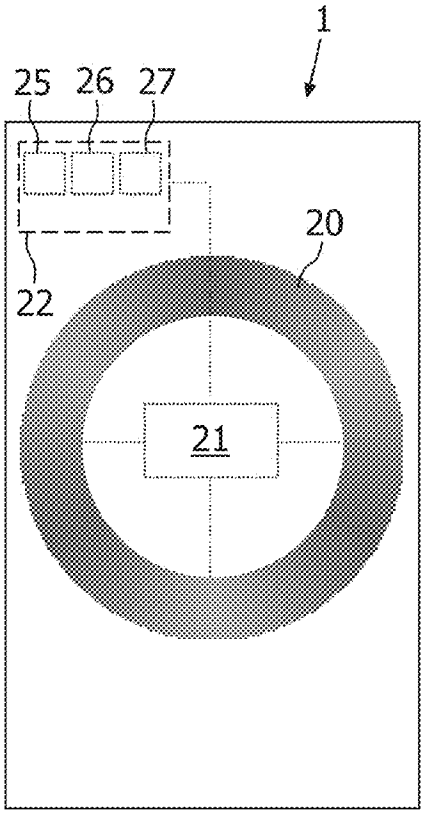

FIGS. 3A-3C are schematic illustrations of control devices according to embodiments of the invention.

In FIG. 3A, the control device 1 has a hue selection surface 20 displaying a plurality of hues H available for the light L of the light source 1. The hue selection surface 20 displays a plurality of printed available hues H for the light L. The control device further has interaction detection means 21 (drawn as a dotted box) and control means 22 (drawn as a dashed box), which are interconnected. The interaction detection means 21 is capable of detecting an interaction between the hue selection surface 20 and a user of the control device 1 in selecting a hue H for the light L of said light source 2. The interaction detection means 21 may comprise, for example, mechanical detection means (e.g. a pressure sensor), electrical detection means (e.g. a capacitive sensor), optical detection means (e.g. visual sensing), or a combination of these. The control means 22 registers signals obtained from the interaction detection means 21 and may perform one or more operations, as will be explained in more detail below.

In FIG. 3B, the control device 1 also has a hue selection surface 20 displaying a plurality of hues H available for the light L of the light source 1. In contrast to the control device 1 having a hue selection surface 20 with printed hues H of FIG. 3A, the available hues H for the light L of light source 2 are provided by a plurality of light-emitting elements 23 here, e.g. light-emitting diodes (LEDs). The light emitting-elements 23 are thus capable of emitting light of different colors. A diffuser plate (not shown) may assist in suggesting a continuous range of available hues H from which a selection may be made on the hue selection surface 20. Suitable LEDs are available, for example, from COTCO.

The control device 1 again comprises interaction detection means 21 (drawn as a dotted box) and control means 22 (drawn as a dashed box), which are interconnected. The interaction detection means 21 is capable of detecting an interaction between the hue selection surface 20 and a user of the control device 1 in selecting a hue H for the light L of said light source 2. The interaction detection means 21 may comprise, for example, mechanical detection means (e.g. a pressure sensor), electrical detection means (e.g. a capacitive sensor), optical detection means (e.g. visual sensing), or a combination of these. The control means 22 registers signals obtained from the interaction detection means 21 and may perform one or more operations as will be explained in more detail below. The control means 22 is further capable of controlling the light-emitting elements 23.

It should be appreciated that the light-emitting elements 23 may be an integral part of the hue selection surface or may be arranged near a selection surface 24 where the actual selection of the hue is made, as shown in FIG. 3C. In such an embodiment, the hue selection surface 20 comprises this selection surface 24 for selecting the hue and the area that accommodates the light-emitting elements 23. The same holds, of course, for the printed hue selection surface as shown in FIG. 3A.

As shown in FIGS. 3A-3C, the hue selection surface 20 preferably is a ring-shaped surface. However, it should be appreciated that other shapes fall within the scope of the invention including, but not limited to, triangularly shaped surfaces, oval surfaces, etc. Also, it should be noted that the hue selection surface is not necessarily flat.

In operation, a user may operate the control device of FIGS. 3A-3C to control the light L of the light source 2 by selecting a desired hue H on the hue selection surface 20. The available hues H are printed (FIG. 3A) or indicated by the light-emitting elements 23 (FIG. 3B) on the hue selection surface 20. The desired hue H may be selected, for example, by touching the hue selection surface 20 with a finger at the position corresponding to the desired hue H. This interaction is detected by the interaction detection means 21, which use, for example, a capacitive sensor. The interaction detection means 21 communicates the selected position to the control means 22, which control means 22 in turn relates the position to a specific hue H corresponding to the hue H displayed on the hue selection surface. The control means 22 may use a look-up table for this purpose. The selected hue H is subsequently communicated to the light source 2 such that the light L of the light source 2 assumes the selected desired hue H. If the user desires another hue H for the light L of the light source 2, he may simply select this hue with his finger on the hue selection surface 20.

The control device 1 of the invention thus enables the user to select the desired hue H of the light L of the light source 2 simply by interacting with the hue selection surface 20 that displays the available hues H. Consequently, the control device 1 can be operated easily and intuitively.

It should be appreciated that the hue selection surface 20 may present a large amount of available hues H for the light L. In the exemplary embodiment of FIG. 4A, the hue selection surface 20 displays 128 hues H0-H127 that are available for the light source 2. As a result of the limited dimensions of the ring-shaped hue selection surface 20, adjacent hues H are displayed close to each other, and the selection of a specific desired hue H may prove difficult. Typically, the length dimension and width dimension of the control device 1 range from 10 to 100 mm. However, the invention may also be implemented with a larger display in the range of e.g. 20 to 30 cm, for example of a touch screen of a notebook or flat screen tablet. The embodiments of the invention discussed below enable the user to zoom in on the hue selection surface 20 in order to facilitate the selection of a particular desired hue H. The zoom factor may be adjustable; a larger zoom allows a more precise selection, whereas a smaller zoom allows a wider zoom range to be displayed on the hue selection surface 20.

For the embodiment of the control device 1 of FIG. 3A (printed hue selection surface 20), the zoom function may be accomplished in that the control device 1 is provided with assigning means 25 capable of assigning a subset of the available printed hues to the hue selection surface 20. After the rough selection of a hue H, the assigning means 25 only assign hues H to the full hue selection surface 20 that are close to the envisaged hue. The number of assigned hues may be programmed in advance. This number is smaller than the total of available hues H for the light L and, consequently, the area for each assigned hue H is larger. An accurate selection of a desired hue H on the hue selection surface 20 is thus facilitated. Since the available hues H for the light L of the light source 2 are printed on the hue selection surface 20 in the embodiment of FIG. 3A, the user cannot actually observe the assigned hues on the hue selection surface 20. However, the effect of selecting an assigned hue H can be observed by looking directly at the light source 2 itself.

Figure 4A:
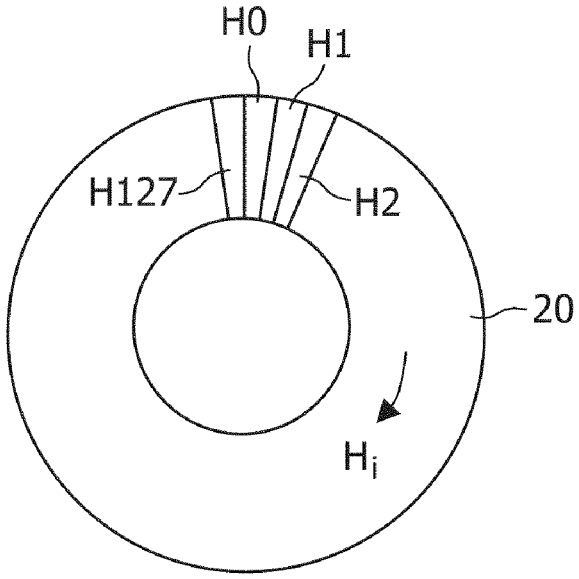
FIGS. 4A and 4B are schematic illustrations of a hue selection surface for a control device according to an embodiment of the invention.

In operation, a user may select, for example, a hue H45 on the hue selection surface 20 that initially allows selection of all available hues H0-H127 as shown in FIG. 4A. After this selection, the assignment means assigns a subset of only hues H35-H55 to the hue selection surface 20. The user may then look at the light source 2 and select e.g. hue H47 by interacting with the hue selection surface 20. Both the selection of hue H45 and that of hue H47 are detected by the interaction detection means 21. The assignment means 25 accomplishes that the area for selecting hue H47 was larger than the area for hue H47 on the initial hue selection surface 20 of FIG. 4A.

The subset H35-H55 may be assigned to the hue selection surface 20, for example, in that the duration of the interaction of the user's finger with the hue selection surface 20 is detected by duration detection means 26, shown in FIGS. 3A-3C. For example, the user may first select the hue H45 by touching the hue selection surface with his fingertip. In this way large steps can be taken to vary the desired hue H while the hue selection surface 20 is watched. For fine tuning to the desired hue H47, the finger tip is kept in contact with the hue selection surface 20 for a longer time. When the contact between the fingertip and the hue selection surface has been maintained for more than a predetermined time of e.g. 1 second, the assignment means 25 assigns the subset of hues H35-H55 to the hue selection surface 20. Thus the assignment of the subset of available hues is dependent on the detected duration of the interaction. If the fingertip is now moved over the hue selection surface, a full rotation of the finger tip over the ring-shaped hue selection surface 20 may accomplish the selection of one of the hues H35-H55 (e.g. H47) for the light L of the light source 2.

Alternatively or in addition, velocity detection means 27 capable of detecting the velocity of the interaction between the user and the hue selection surface 27 may be used to trigger the assignment of the subset of available hues H to the hue selection surface. This feature provides speed-dependent navigation. If the user's fingertip is moved over the hue selection surface 20 with a speed above a threshold velocity, the hues H will change in correspondence with the original printed available hues H0-H127. If the fingertip speed is below the threshold, a subset of hues H is assigned to the hue selection surface 20 and a more gradual change of hues H is experienced by the user when looking at the light source 2 during interaction with the hue selection surface 20. In other words, the assignment of the subset of available hues is dependent on the detected velocity of the interaction.

The embodiments of the invention as shown in FIGS. 3B and 3C, in which light-emitting elements 23 are used, allow the zoom function to have effect on the display of the available hues H on the control device 1 itself. The control means 22 of the control device 1 are capable here of controlling the light-emitting elements 23 into displaying at least one subset of the available hues H on said hue selection surface 20, and the interaction detection means 21 is capable of detecting a selection of a hue H from this subset.

Figure 4B:
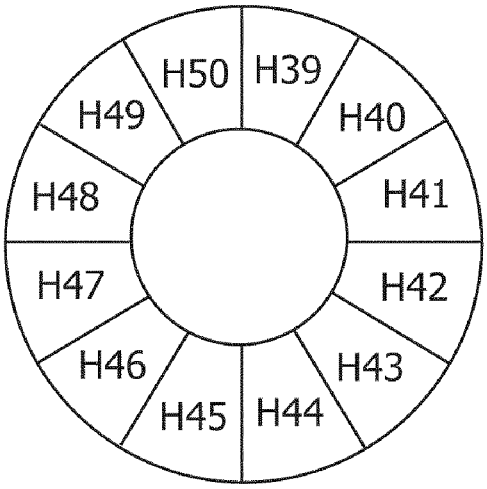

In an exemplary embodiment, the control device 1 comprises activation means 28 for activating the control means 22 to control the light emitting-elements 23 so as to display the subset on said hue selection surface 20. For example, a user may first select a hue H45 and then operate the activation means 28. The control means 22 then control the light-emitting elements 23 to display hues H39-H50 on the hue selection surface 20, as illustrated in FIG. 4B. The user may subsequently select the desired hue, e.g. H47.

It should be noted that the zoom function is not necessarily triggered by a dedicated activation means. Similarly to the embodiment of FIG. 3A, the zoom function may again be triggered by duration detection means 26 or velocity detection means 27. It should further be appreciated that, in contrast to the printed hue selection surface 20 of FIG. 3A, the zoom function for achieving a subset of the available hues H is visualized by the light-emitting elements 23 in the embodiments of FIGS. 3B and 3C.

The zoom function may be reset in several ways, e.g. by a dedicated reset button or by moving the finger over the hue selection surface 20 at a high speed as an imaginary mixing of the hues H.

Figure 5A:
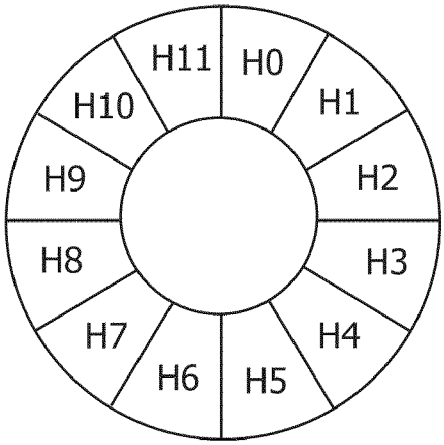
FIGS. 5A-5C are schematic illustrations of a hue selection surface showing a first, second, and third portion of available hues.
Figure 5B:
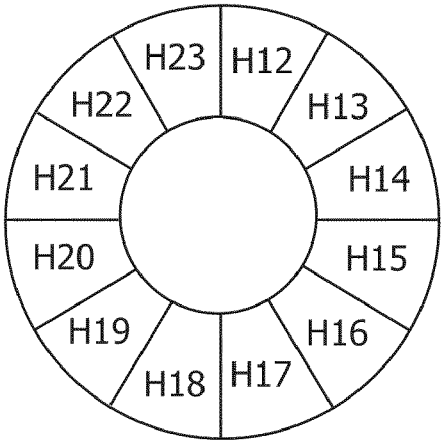
Figure 5C:
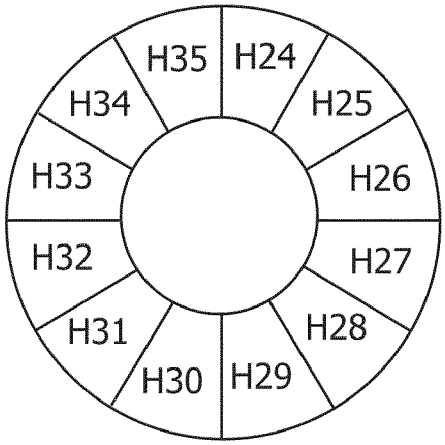

Another embodiment for displaying a large amount of available hues H on the hue selection surface 20 while allowing the user to select a desired hue accurately is presented in FIGS. 5A-5C. The control means 22 may be capable of controlling the light-emitting elements 23 such that only a portion of the total set of available hues H for the light L is displayed on the hue selection surface 20. In FIGS. 5A-5C, the total set of available hues ranges from H0-H35. This set is divided into three portions H0-H11, H12-H23, and H24-H35.

In operation, the user brings his fingertip into contact with the hue selection surface 20. He may then select one of the hues H0-H11. If the user continues to rotate his fingertip, the first portion H0-H11 is replaced by the second portion H12-H23, as illustrated in FIG. 5B. After a second rotation, the second portion is replaced by the third portion H24-H35, as illustrated in FIG. 5C. Thus, after no more than three rotations, the initial portion H0-H11 of FIG. 5A is displayed again. This function can be accomplished through cooperation of the interaction detection means 21 and the control means 22 that control the light-emitting elements 23 into emitting light of hues H according to this scheme. It should be noted that, instead of replacing entire portions of available hues at once, also portions of subsequent portions may replace portions of previous portions. For example, after the user's fingertip has passed hue H0, this position just passed may already display hue H12 while the positions that have not yet been passed on the hue selection surface 20 still display H1-H11. Of course, it is not necessary for H0 to be immediately replaced by H12. For example, H0 may be replaced by H12 when the user's fingertip passes e.g. from H5 to H6.

The light-emitting elements 23 of the control devices shown in FIGS. 3B and 3C may be used to present further color selection possibilities to a user.

Figure 6:
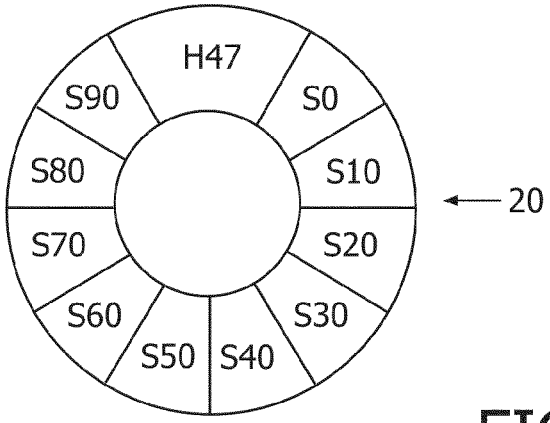
FIG. 6 is a schematic illustration of a hue selection surface according to an embodiment of the invention.

The control device 1 may be capable, for example, of selecting both the hue H and the saturation S of the light L to be emitted by the light source 2. Such a control device 1 may operate as follows. After selection of the desired hue H (possibly with the use of zooming according to one of the above embodiments), the hue selection surface 20 may display a series of available saturations S for the light L, as depicted in FIG. 6. The top segment shows the desired, fully saturated hue, indicated as H47. As the hue H47 is fully saturated, it represents a saturation 5100. The other segments display the series of saturation levels available for the hue H47, indicated as S0 . . . S90. The available saturation levels are displayed on the hue selection surface by the light-emitting elements 23 as instructed by the control means 22. A selection of a desired saturation S may be detected by the interaction detection means 21. The switch from hue selection to saturation selection may be triggered, for example, by detection of the velocity of the interaction between the user and the hue selection surface 20. Fast movement may be related to selecting the desired hue H and slow movement to selecting a desired saturation S for the selected hue H. It should be appreciated that the zoom functionality as described for the hue selection may also be used for the selection of the saturation S.

Although "white" is not officially regarded as a hue, the control device 1 according to the invention may be used to select flavors of white for the light L of the light source 2. By displaying these flavors of white, e.g. ranging from "cold white" to "warm white" on the hue selection surface 20 of one of the control devices 1 of FIGS. 3A-3C, a selection of a white flavor can be detected by the interaction detection means 21. If the hue selection surface 20 displays the various "whites" according to the black body radiation line BBL in the CIE color space of FIG. 2B, rotation of a user's finger over the hue selection surface 20 may mimic the color change from sunset to midday light to sunrise or vice versa.

Figure 7:
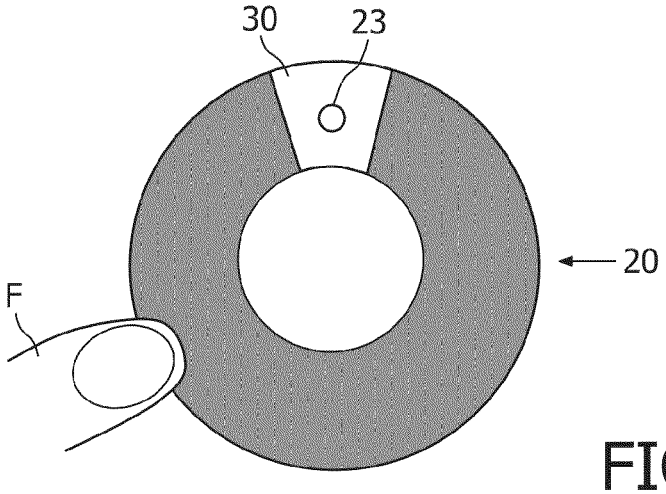
FIG. 7 is a schematic illustration of a hue selection surface with a selection surface part.

In the previous embodiments, a hue H was selected by applying a user's finger to the corresponding position of the hue selection surface 20. The embodiment of the invention as shown in FIG. 7 illustrates an alternative selection possibility. The hue selection surface 20 comprises a selection surface part 30. The selection surface part 30 may be provided, for example, in that the light emitting elements 23 emit a brighter light therein than outside the selection surface part 30. In FIG. 7, this is illustrated by the grey area of the hue selection part 20. The control means 22 is capable of controlling the light-emitting elements 23 into displaying a selected hue H on the selection surface part 30 in response to the interaction between said hue selection surface 20 and the user.

In operation, the user may rotate with his finger over the hue selection surface 20. The control means 22 controls the light-emitting element 23 at the selection surface part 30 so as to emit light of different hues corresponding to the position of the user's finger F on the hue selection surface. These positions are detected by the interaction detection means. Consequently, operation of the control device 1 with a hue selection surface 20 as depicted in FIG. 7 resembles the turning of a mechanical knob. The light L of the light source 2 assumes the hue H displayed in the selection surface part 30.

Figure 8:
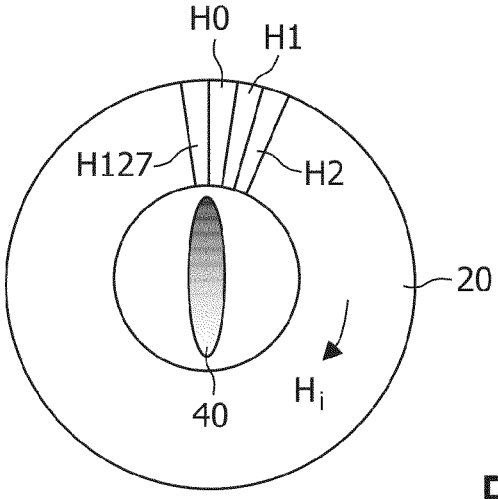
FIG. 8 is a schematic illustration of a control device with a saturation selection surface.

The control device 1 may comprise a separate hue selection surface 20 and saturation selection surface 40. The hue selection surface 20 may be implemented and function in accordance with any of the embodiments described above. The saturation selection surface 40 may also comprise light-emitting elements (not shown) to indicate saturation levels S available for a particular selected hue H. Preferably, the saturation levels S are printed, as shown in FIG. 8, for reasons of cost. In such an embodiment, of course, the available saturation levels S do not adapt to the selected hue H. However, as users become more familiar with the selection of hues H and saturation levels S for a light source 2, they will grasp the function of the saturation selection surface 40 and not mistake it for hue selection control. Selection of a saturation S at the saturation selection surface 40 may be detected as described for the selection of a hue H on the hue selection surface. The interaction detection means 21 may be used to detect interaction with the saturation selection surface 40. However, separate and/or different interaction detection means (not shown) may be used as well. Saturation detection may be facilitated by the use of the control means 22.

In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The mere fact that certain measures are recited in mutually different dependent claims does not indicate that a combination of these measures cannot be used to advantage.

What is claimed is:

1. A control device for controlling the hue of light emitted by a light source, wherein said control device comprises:

a hue selection surface capable of displaying one or more hues available for said light of said light source;

interaction detection means for detecting interaction between said hue selection surface and a user of said control device in selecting said hue for said light of said light source;

wherein said hue selection surface displays a plurality of printed available hues for said light;

wherein said interaction detection means being capable of detecting a selection of at least one of said printed displayed hues by said user;

said control device includes assigning means for assigning at least one subset of available printed hues and displaying said at least one subset of available printed hues on said hue selection surface, said interaction detection means being capable of detecting a selection of a hue of said assigned subset.

2. The control device according to claim 1, wherein said control device further comprises velocity detection means for detecting the velocity of the interaction between said user and said hue selection surface and said assigning means is capable of assigning a subset of said available printed hues to said hue selection surface in dependence on said detected velocity.

3. The control device according to claim 1, wherein said hue selection surface comprises a plurality of light-emitting elements capable of displaying said available hues for said light of said light source, and said interaction detection means is capable of detecting a selection of at least one of said displayed hues by said user.

4. The control device according to claim 3, wherein said control device comprises control means for controlling said light-emitting elements into displaying at least one subset of said available hues on said hue selection surface, and wherein said interaction detection means is capable of detecting a selection of a hue of said subset.

5. The control device according to claim 4, wherein said control device comprises activation means for activating said control means for controlling said light-emitting elements into displaying said at least one subset on said hue selection surface.

6. The control device according to claim 5, wherein said control device comprises velocity detection means for detecting the velocity of the interaction between said user and said hue selection surface, and said control means is capable of controlling said light-emitting elements into displaying said subset of available hues on said hue selection surface in dependence on said detected velocity.

7. The control device according to claim 3, wherein said interaction detection means is capable of detecting a selection of a hue from among said available hues, and said control device comprises control means for controlling said light-emitting elements into displaying at least one series of available saturation levels on said hue selection surface corresponding to said selected hue, and wherein said interaction detection means are capable of detecting a selection of a saturation from said series of available saturations.

8. The control device according to claim 7, wherein said control device comprises velocity detection means for detecting the velocity of the interaction between said user and said hue selection surface, and said control means is capable of controlling said light-emitting elements into displaying said series of available saturation levels in dependence on said detected velocity.

9. The control device according to claim 3, wherein said control device comprises control means capable of controlling said light-emitting elements into displaying a first portion of said available hues on said hue selection surface and is playing a second portion of said available hues subsequent to said first portion such that at least part of said second portion of available hues replaces at least part of said first portion of available hues.

10. The control device according to claim 3, wherein said hue selection surface comprises a selection surface part, and said control means is capable of controlling said light-emitting elements into displaying a selected hue on said selection surface part in response to said interaction between said hue selection surface and said user.

11. The control device according to claim 3, wherein said control device comprises a diffuser plate arranged over one or more of said light-emitting elements.

12. The control device according to claim 1, wherein said hue selection surface is capable of displaying a single hue and several saturation levels of said hue.

13. The control device according to claim 1, wherein said hue selection surface displays or is capable of displaying a plurality of white surface portions substantially corresponding to a black body line (BBL).

14. The control device according to claim 1, wherein said hue selection surface comprises a ring-shaped surface.

15. The control device according to claim 1, wherein said control device is furthermore capable of selecting the saturation of said light in that it comprises a saturation selection surface capable of displaying one or more saturation levels available for said light source.

16. The control device according to claim 15, wherein said interaction detection means is capable of detecting interaction between said saturation selection surface and a user of said control device in selecting said saturation for said light of said light source.

17. The control device according to claim 15, wherein said saturation selection surface comprises one or more printed saturation levels for one or more hues.

18. A control device for controlling the hue of light emitted by a light source, comprising:

an annular hue selection display surface presenting a plurality of hues capable of being emitted by said light source, said hue selection display surface having a plurality of light emitting elements capable of emitting lights of a plurality of colors;

a user touch detector responsive to a selection by a user of one of said plurality of hues presented on said annular hue selection surface available for said light source;

a controller electronically connected to said user touch detector and said hue selection surface to register signals obtained from said user touch detector;

wherein said controller is operably connected to said light emitting elements of said hue selection display surface;

said controller further operable to assign at least one subset of said plurality of available hues to said hue selection display and said user touch detector is operable to detect a user selection of a hue of said subset of hues displayed.

* * * * *